United States Patent [19]

Noé

[11] 4,074,555

[45] Feb. 21, 1978

[54] METHOD OF AND APPARATUS FOR IMPROVING HOT-ROLLED SHEET-METAL STRIPS

[75] Inventor: Oskar Noé, Mulheim (Ruhr), Germany

[73] Assignee: BWG Bergwerk-und Walzwerk Maschinenbau Gesellschaft mit beschrankter Haftung, Duisburg, Germany

[21] Appl. No.: 714,279

[22] Filed: Aug. 13, 1976

[30] Foreign Application Priority Data

Aug. 21, 1975 Germany ..... 2537188

[51] Int. Cl.[2] ..... B21D 1/02

[52] U.S. Cl. ..... 72/128; 72/163; 72/201

[58] Field of Search ..... 72/205, 160, 200, 201, 72/202, 161, 9, 17, 128

[56] References Cited

U.S. PATENT DOCUMENTS

| | | | |
|---|---|---|---|
| 1,819,763 | 8/1931 | Blecker | 72/161 X |
| 3,261,191 | 7/1966 | Wasson | 72/9 |
| 3,292,402 | 12/1966 | O'Brien | 72/17 |
| 3,326,026 | 6/1967 | Guillot | 72/163 |
| 3,429,164 | 2/1969 | Oganowski et al. | 72/161 |

*Primary Examiner*—Milton S. Mehr
*Attorney, Agent, or Firm*—Karl F. Ross

[57] ABSTRACT

A sheet-metal strip coming hot from a rolling mill is subjected to alternate bending in opposite directions before being wound on a mandrel, preferably while still in a temperature range of about 600° C to 800° C in the case of steel. The bending is carried out by deflecting rollers which may be mounted upstream of a pair of reverse-feed rollers, acting as a strip brake, preceding the driven mandrel.

8 Claims, 2 Drawing Figures

METHOD OF AND APPARATUS FOR IMPROVING HOT-ROLLED SHEET-METAL STRIPS

FIELD OF THE INVENTION

My present invention relates to a method of and an apparatus for improving the quality of sheet-metal strips coming from a rolling mill.

BACKGROUND OF THE INVENTION

Sheet-metal strips are rolled at high temperatures from billets or blooms to a thickness generally ranging between 1.2 and 10 mm. After leaving the last hot-rolling stage, the strip passes over supporting rollers to a coiling station where it is wound on a mandrel. In order to insure even winding, especially when the trailing end of the strip has left the mill, it is customary to position a strip brake immediately upstream of the coiling station whereby the strip is held under tension, e.g. with the aid of a reverse-rotating roller pair. On passing from the rolling mill to the coiling station, the strip may be subjected to forced cooling by means of water sprays.

When arriving at the coiling station, such a strip may have various imperfections including bends at its center, waviness along its lateral edges and thickness irregularities along its cross-section, e.g. because of nonuniform operation of spray heads distributed above the path of the strip. A minor but annoying defect is also the frequently encountered curving of the transverse strip edges at the leading and trailing ends.

OBJECTS OF THE INVENTION

The general object of my present invention is to provide a method of and means for minimizing these imperfections in a hot-rolled sheet-metal strip.

An ancillary object is to facilitate the removal of scale formed on the surfaces of hot-rolled strips, especially upon cooling by a water spray.

SUMMARY OF THE INVENTION

I realize these objects, in accordance with my present invention, by alternatively bending the hot-rolled strip in opposite directions while the strip is still at an elevated temperature, preferably in a range of about 600° to 800° C in the case of steel or other ferrous metal, for example.

In my prior U.S. Pat. No. 3,777,532 I have disclosed a system for the alternate bending of metallic bands or strips in the cold state, with the aid of rollers of progressively smaller diameter, for the purpose of elongating the strip and reducing its thickness. Such an elongation also occurs, albeit only incidentally and to a limited extent, in the process according to my present invention where the greater deformability of a hot strip subjected to such bending tends to even out any nonuniformity in thickness. Thus, where a slight deviation from parallelism of the rollers in the last hot-rolling stage produces a wedge-shaped cross-section, the elongation of the strip occurs predominantly at the expense of its thickness along its heavier edge and at the expense of its width along its thinner edge so that a slightly narrower strip of substantially uniform thickness results. In practice, the alternate bending may be carried to such an extent that the average elongation of the strip lies between about 1% and 10%, preferably in the vicinity of 3%. I have also found that this method may completely eliminate any planar anisotropy originally present in the hot-rolled strip, i.e. a difference in longitiudinal and transverse strength. An increased penetration resistance (Rockwell hardness) is likewise observed. Finally, the alternate deflection in opposite directions breaks up an partly removes any scale layer present on the strip surface.

BRIEF DESCRIPTION OF THE DRAWING

The above and other features of the invention will now be described in detail with reference to the accompanying drawing in which.

SPECIFIC DESCRIPTION

Figure 1:
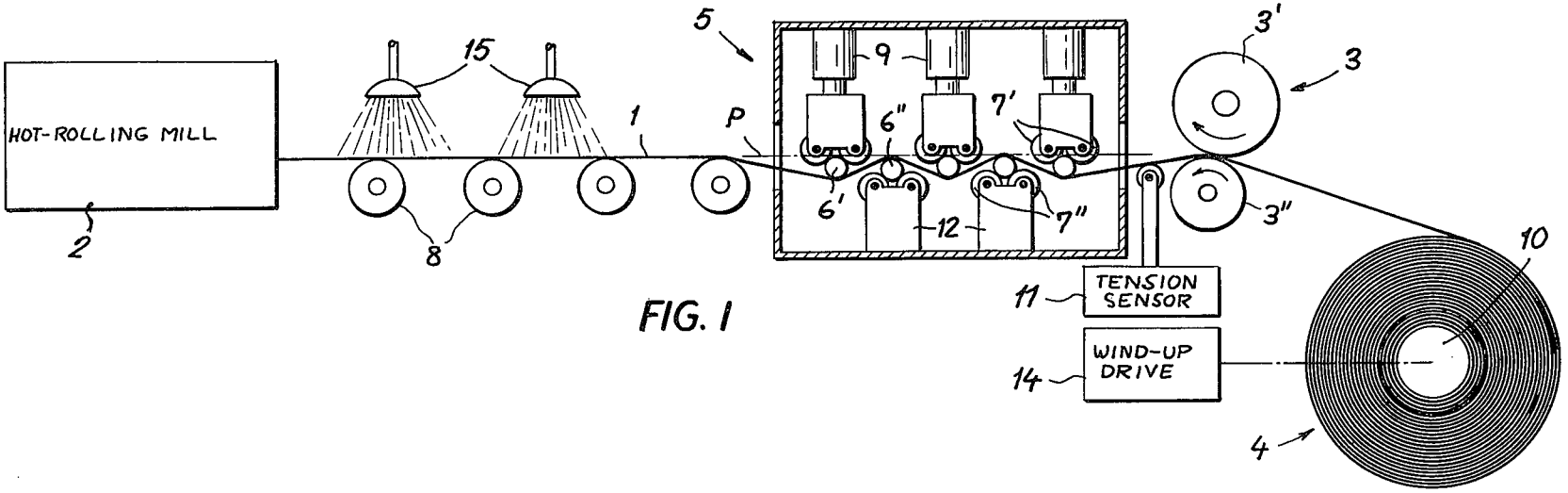
FIG. 1 is a schematic side-elevational view of the path of a hot-rolled strip between a rolling mill and a coiling station, the strip passing through an apparatus according to my invention.

The system shown in the drawing comprises a hot-rolling mill 2 from which a metal strip 1, e.g. of sheet steel, passes generally horizontally over a set of idle supporting rollers 8 to a mandrel 10 forming part of a coiling station 4. A strip brake 3, comprising two reverse-rotating rollers 3' and 3'', is mounted immediately upstream of the coiling station 4 and is preceded by a tension sensor 11 which can be used to determine the elongation imparted to the strip 1 by an apparatus 5 constituting a bending station according to the present invention. This bending station, inserted in the path of the strip between the supporting rollers 8 and the strip brake 3, comprises a multiplicity of upper and lower deflecting rollers 6', 6'' which rest against respective pairs of back-up rollers 7', 7'' and alternately bear upon the upper and lower strip surfaces. The lower deflecting and back-up rollers 6'', 7'' have stationary mountings 12 whereas the upper rollers 6', 7' are supported on jacks 9 for selective raising and lowering to vary the extent of penetration of the deflecting rollers into the path of the strip. The lower deflecting rollers 6'' are tangent to a plane P lying at the level at which the strip 1 is supported by the idler rollers 8; the nip of the braking rollers 3' and 3'' lies at the same level.

The array of deflecting rollers 6', 6'' and back-up rollers 7', 7'' may have a construction of the type disclosed in commonly owned application Ser. No. 714,277, now U.S. Pat. No. 4,043,162 filed by Wolfgang Skrober and me on even date with the present application. According to that disclosure, shafts of the back-up rollers are supported in V-shaped bearings rigid with a common beam.

The jacks 9 may be operated, manually or automatically, in response to an output signal from sensor 11 in order to maintain the elongation of strip 1 at a desired value. In general, the extent of overlap between fixedly positioned lower rollers 6'' and the vertically adjustable upper rollers 6'' will vary with the thickness of the strip, being greater for thin strips at the lower end of the aforementioned range of 1.2—10 mm and less for heavier strips in the upper part of that range.

Figure 2:
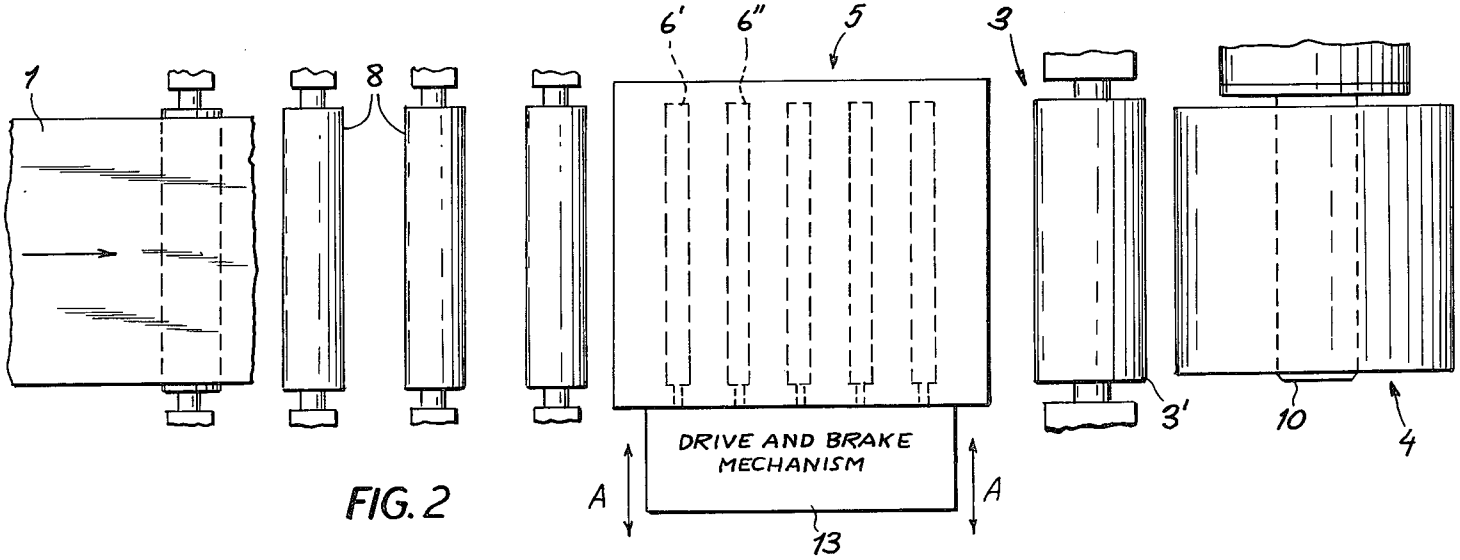
FIG. 2 is a top view of the apparatus and other elements shown in FIG. 1, with the strip partly broken away.

A drive and brake mechanism 13 is coupled, directly or through the intermediary of back-up rollers 7' and 7'', with the deflecting rollers 6', 6'' for rotating them at a speed commensurate with the rate of advance imparted to the strip 1 by the stages of rolling mill 2 and by a wind-up drive 14 of coiling station 4 programmed to keep the strip velocity constant. Rotation of these deflecting rollers facilitates the threading of the leading end of a new strip 1 into the bending station 5; conversely, a retardation of these rollers by the mechanism 13 will impart additional tension to the strip being wound on mandrel 10 so as to supplement the action of braking station 3. The upper braking roller 3' may, in fact, be omitted in this case. The entire apparatus 5 can be moved transversely out of the path of the strip as schematically indicated by arrows A in FIG. 2.

The strip 1 exiting from rolling mill 2 may be forcibly cooled by spray nozzles 15 disposed in the region of supporting rollers 8, ahead of bending station 5. The operation of the spray nozzles should be so controlled that the strip 1 still has an elevated temperature preferably between 600° and 800° C on reaching the bending station.

I claim:

1. A method of improving the quality of a hot-rolled strip of ferrous sheet metal, comprising the steps of:

(a) cooling a hot-rolled strip, on its exit from a rolling mill, to a temperature in an elevated range of substantially 600° to 800° C;

(b) alternatively bending said strip at said temperature in opposite directions with resulting elongation and equalization of deformations due to nonuniform cooling in step (a); and (c) thereupon winding the strip around a mandrel.

2. A method as defined in claim 1 wherein the alternate bending is carried to an extent elongating said strip by substantially 1% to 10%.

3. An apparatus for improving the quality of hot-rolled strips of ferrous sheet metal coming from a rolling mill, comprising a bending station downstream of said rolling mill equipped with a plurality of parallel deflecting rollers and transport means for drawing a hot-rolled strip through said bending station after partial cooling of said strip to a temperature in an elevated range of substantially 600° to 800° C, said deflecting rollers being positioned to bear alternately and overlappingly upon opposite strip surfaces whereby the strip is forced to follow a wavy path.

4. An apparatus as defined in claim 3 wherein said transport means includes a winding station downstream of said bending station for coiling said strip on a mandrel.

5. An apparatus as defined in claim 4, further comprising strip-braking means interposed between said bending station and said winding station.

6. An apparatus as defined in claim 4 wherein said bending station is provided with repositioning means for adjusting the extent of overlap between alternate deflecting rollers.

7. An apparatus as defined in claim 4, further comprising tension-sensing means between said bending station and said winding station for determining the degree of elongation imparted to the strip by said deflecting rollers.

8. An apparatus as defined in claim 3, wherein said deflecting rollers are provided with drive and brake means for controlling their rotary speed.

* * * * *